US005113656A

United States Patent [19]

Swansen

[11] Patent Number: 5,113,656

[45] Date of Patent: May 19, 1992

[54] EXTERNAL COMBUSTION ENGINE AND HEAT PUMP

[76] Inventor: Theodore L. Swansen, 4424 Pleasant Lake Rd., East Troy, Wis. 53120

[21] Appl. No.: 650,182

[22] Filed: Feb. 4, 1991

[51] Int. Cl.[5] ..... F02G 1/044

[52] U.S. Cl. ..... 60/525; 60/517

[58] Field of Search ..... 60/517, 525; 62/6

[56] References Cited

U.S. PATENT DOCUMENTS 3,940,934 3/1976 Hakansson ..... 60/525

4,472,938 9/1984 Lorant ..... 60/525

*Primary Examiner*—Allen M. Ostrager

*Attorney, Agent, or Firm*—Fuller, Ryan & Hohenfeldt

[57] ABSTRACT

In an engine based on the Stirling cycle the individual hot side and cold side cylinders typically used in conventional Stirling engines are subdivided into a cluster of parallel cylinders of smaller diameter than the single cylinder but with the area of the cylinder walls greater than that for the single cylinder for the same displacement and with spaces between the cylinders in the cluster to allow a heating or cooling medium to flow through the spaces and contact the enlarged surface area for tranferring heat into or out of the cylinders more efficiently. The described engine has the hot side cylinder cluster disposed horizontally to facilitate allowing hot gases of combustion to flow through the spaces between the subdivided cylinders by natural convection. Moreover, having the hot side cylinders disposed horizontally facilitates confining the hot combustion gases to one end region of the cylinders in isolation from the rest of the engine structure. When the engine is operating, the hot side piston cluster leads the cold side piston cluster by 45 angular degrees. The engine can also be driven with an electric motor to serve as a heat pump for either cooling or heating a space or substance.

8 Claims, 2 Drawing Sheets

EXTERNAL COMBUSTION ENGINE AND HEAT PUMP

BACKGROUND OF THE INVENTION

The invention disclosed herein pertains to a machine working on a thermodynamic cycle which converts heat energy to work using heat added to the machine from a source external to the cylinders of the machine and serves as a heat pump when the machine is driven by an independent prime mover such as an electric motor.

A rudimentary Stirling engine is an example of such machine. It comprises two cylinders which each contain a piston A conduit connects the head ends of the cylinders together and there is a heat exchanger in the conduit The system is closed so the sum of the amount of gas in the two cylinders plus the conduit and heat exchanger is constant. One of the cylinders is maintained at a low temperature, that is, it rejects heat during a compression phase of the cycle and the other cylinder is maintained at a high temperature and it absorbs heat during an expansion or decompression part of the cycle. Piston movements are such that gas is transferred back and forth between the hot and cold cylinders. When more of the gas is in the hot cylinder, the pressure rises and when the gas is transferred back to the cold cylinder the pressure falls again. When operating in the engine mode, the ideally isothermal compression stroke starts with most of the working gas in the cold cylinder of the engine. After the compression stroke is near completion the piston in the hot cylinder moves in a direction to expand the volume in the hot cylinder which results in transfer of the gas to the hot cylinder. Because external heat is applied to the hot cylinder the pressure in that cylinder rises, the gas is expanded and the piston in the hot cylinder does useful work. At any given position of the piston in the cold cylinder, the pressure is higher on the outward stroke with some of the gas hot than it is on the inward stroke when all of the gas is cold. Hence, more work is done on the piston in the cold cylinder during gas expansion than has to be done to recompress the gas and the difference is the net work available from the engine. When gas is transferred from the cold cylinder to the hot cylinder the gas absorbs heat from the heat exchanger which is usually called a regenerator. When gas is transferred from the hot cylinder to the cold cylinder the regenerator removes heat from the gas so the gas enters the cold cylinder at a temperature substantially lower than that which existed in the hot cylinder.

In a practical engine, there may be several pairs of hot and cold cylinders adjacent each other with their pistons connected to a common crankshaft and their cylinders are connected in series. According to conventional practice, heat of combustion such as from a gas flame is applied to the hot cylinder at all times. To obtain the best results the hot gases of combustion are made to flow around the hot cylinder to provide the best opportunity for heat transfer to the gas inside.

The same situation exists when the engine is operated in the heat pump mode wherein the crankshaft is driven rotationally by an independent prime mover such as an electric motor. In the heat pump mode, heat conducted outwardly from the so called cold cylinder is sometimes absorbed in water contained in a jacket which surrounds the cold cylinder. Alternatively, the heat may be absorbed in an air stream passing around the cold cylinder. The hot water or hot air may be used to heat a building or to perform an industrial process. Compression of the gas in the cold cylinder would be an isothermal compression ideally if all of the heat generated in the gas due to compression were transferred to the water or air surrounding the cold cylinder.

It will be evident that it would be highly advantageous to maximize the amount of heat per unit of time absorbed by the gas in the hot cylinder when the machine is being operated as an engine and to maximize the amount of heat that is extracted from the gas in the cold cylinder when the machine is being operated as a heat pump to improve the efficiency or coefficient of performance of the machine and obtain an operating cost benefit in either mode.

SUMMARY OF THE INVENTION

An objective of the invention is to improve the thermal efficiency of engines and heat pumps based on the Stirling cycle by increasing the heat transfer area of the hot and the cold cylinders. A further objective of the invention is to arrange the hot cylinder with its axis in a horizontal plane and the cold cylinder at an angle relative to the hot cylinder such that it is possible to flow the hot gases of combustion upwardly in the natural direction of convection around the hot cylinder. A further advantage of placing the cylinders at an angle is that it allows the hot cylinder piston to be moving ahead of the piston in the cold cylinder. The alternate compression and expansion of the working fluid in the engine requires that one cylinder leads the other. In this way the total volume varies over the required range. By having the hot cylinder lead the cold by 45° a satisfactory result is obtained. By having the cylinders at this angle it is possible to have the throws of the crankshaft at 90° which simplifies its fabrication. Then by using two each of the hot and cold cylinders and pistons it is possible to have inherent balance of the engine with the four crankshaft throws at 90° to each other.

A specific objective and most important feature of the invention is to effect better heat transfer between the working gas within the hot and cold cylinders and the outside of the cylinders by dividing the conventional single large diameter cylinder into a cluster of smaller diameter cylinders which are mounted to a common header and contain individual pistons coupled to a single connecting rod and with space allowed between the cylinders through which the hot gases of combustion or cooling medium has ready access to the outside of the cylinders. One of the problems of external combustion engines has been getting good heat transfer into and out of the cylinders. This is because the surface area of the cylinders and the thickness of their metal walls limit heat flow. By making the cylinders and pistons as a cluster, in accordance with the invention, the area of the cylinders for a given displacement is substantially increased and as the cylinders are smaller in diameter the wall thickness can be reduced Both changes reduce the barrier to heat flow. To illustrate the magnitude of this improvement obtained in the engine disclosed herein, a single piston and cylinder of a diameter of one unit will have a surface of 3.14 units per inch of stroke. By dividing up this piston head area into six cylinders and pistons each will have a diameter of 0.408 units and each of these will have a surface of 1.28 units per inch of stroke making a total of 7.69 units per inch of stroke. At the same time the thickness of the walls can be reduced in direct proportion to the piston diameter improving the heat transfer into the cylinder by 1/.408=2.45. Hence, the combination of both gives 7.69/3.14 × 2.45=6.00 times as much heat flow.

How the foregoing and other more specific objectives of the invention are achieved and implemented will appear in the more detailed description of a preferred embodiment of the invention which will now be set forth in reference to the drawings.

DESCRIPTION OF THE DRAWINGS

In FIG. 1 the so called hot cylinder is designated generally by the reference numeral 10 and the cold cylinder is designated generally by the numeral 11. The hot cylinder is subdivided into a plurality of smaller diameter cylinders 12–17, according to the invention, as can be seen in FIG. 1 and FIG. 2. It will be evident, particularly in FIG. 2 that there are spaces between cylinders, such as the spaces marked 19 and 20, through which a fluid heat absorbing or yielding medium may flow over the cylinders. The subdivided cluster of cylinders 12–17 have their opposite ends sealed into appropriate holes in flat end plates 26 and 27. The end plates have a circular array of holes such as the holes marked 28 and 29 in the respective plates to provide for fastening the plates to headers As shown in FIG. 1, the rear end plate 27 is interfaced in sealing relationship with a header 28. End plate 27 is clamped to the header by means of machine screws such as the one marked 25. There are passageways, such as the one marked 30 in the header which communicate the interior of the cylinders with a duct 31 in a member 32.

Figures 1, 2, 3:
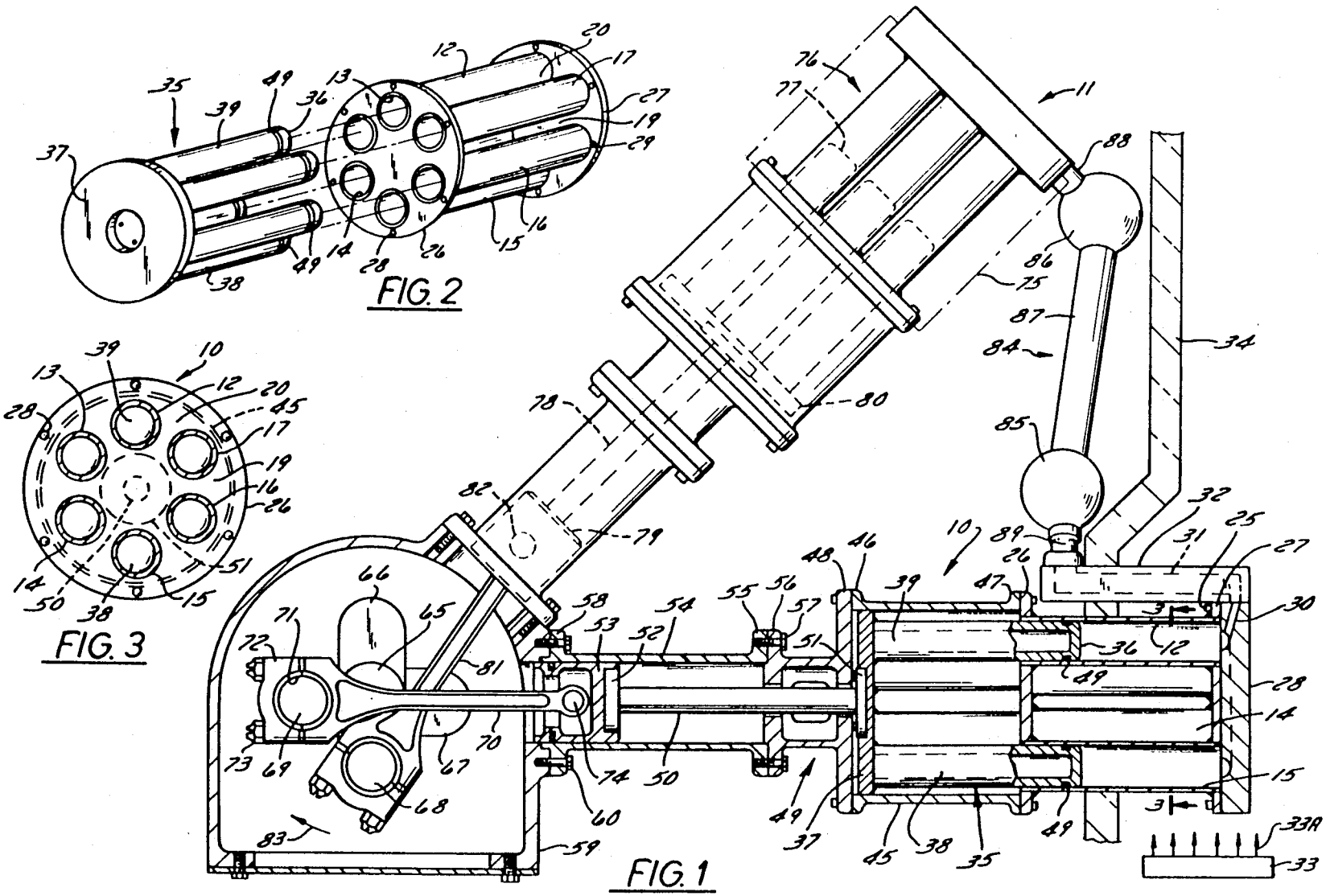
FIG. 1 is a side elevational view of divided cylinder heat pump or engine using the Stirling cycle with some parts shown in section.
FIG. 2 is an exploded perspective view of the subdivided cylinder and cooperating piston assemblies used in the machine.
FIG. 3 shows a section taken on a line corresponding with 3—3 in FIG. 1.
Figure 4A:
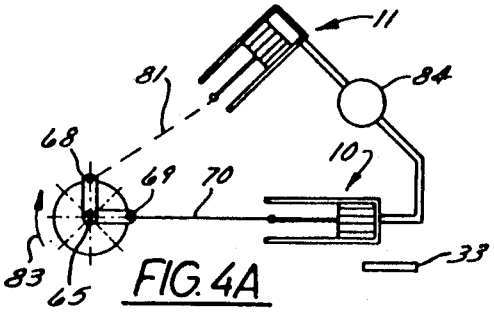
FIG. 4, composed of parts 4A–4I shows a typical operating cycle of an engine using the subdivided cylinder concept operating as a Stirling cycle based engine - heat pump.
Figure 4B:
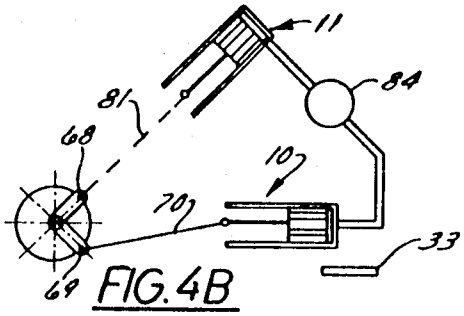
Figure 4C:
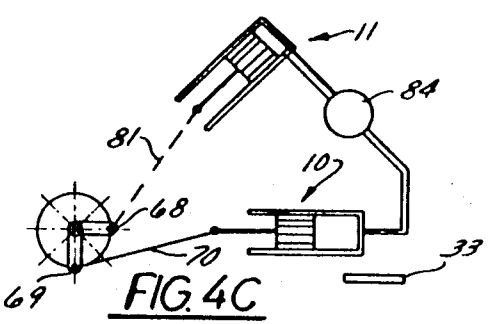
Figure 4D:
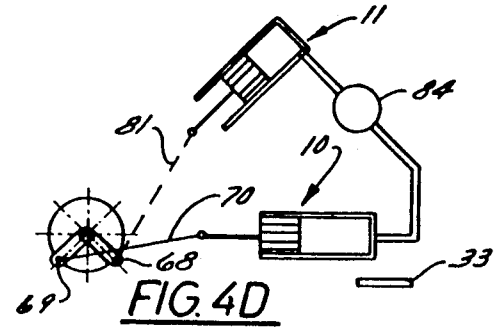
Figure 4E:
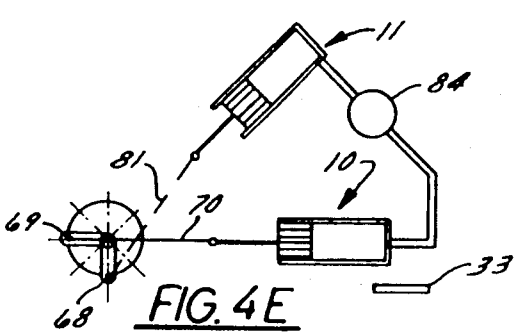
Figure 4F:
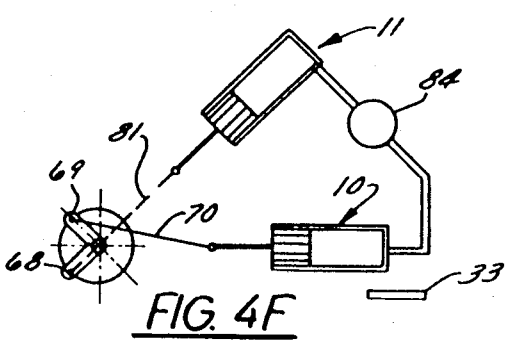
Figure 4G:
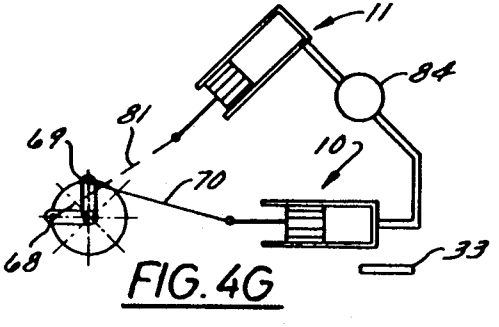
Figure 4H:
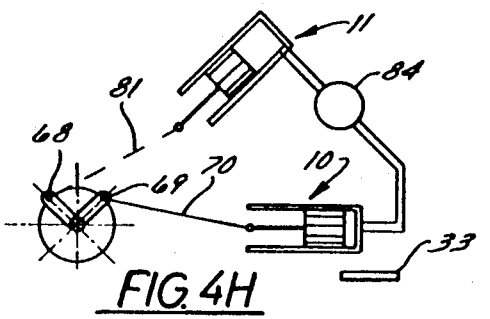
Figure 4I:
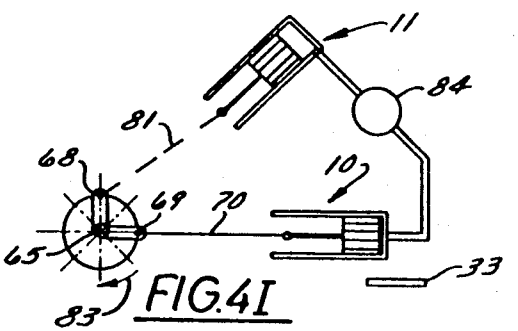

When the device is functioning in the mechanical power generating mode, hot gases of combustion, represented by the arrows 33A, which evolve from a fuel burner 33 flow through the spaces between the cylinders in the cluster for heating the gas which is confined in the cylinders. The right ends of the cylinders in FIG. 1 are subjected to the hot gases and the remainder of the device is isolated from high temperatures by means of a fire resistant wall 34. Arranging the hot cylinder horizontally, in accordance with the invention, facilitates flowing hot gases of combustion over the cluster of cylinders under natural convection wherein hot gases tend to rise.

As is evident in FIGS. 1 and 2, the cluster of pistons, which are generally designated by the numeral 35 are closed on their outer ends 36 and have their inner ends sealingly joined with a header plate 37. The pistons are hollow to minimize engine weight. Two of the pistons 38 and 39 are visible in FIG. 1 and all of the six pistons composing the cluster are visible in FIG. 2. The header 37 supporting the cluster of pistons is slidable within a sleeve 45 which has radially extending shoulders 46 and 47 at opposite ends. Shoulder 47 is bolted to the header plate 26 in which the ends of the cluster of cylinders 12–17 are sealed. The shoulder 46 of the sleeve 45 is secured by means of screws to the face plate 48 of an adapter 49. Each of the pistons has a piston ring 49 fitting into it for the purpose of making a sliding seal with the interior walls of the cylinders in the cluster. No seal is necessary between the periphery of the piston cluster plate 37 and the inside of the sleeve 45 since the piston rings 49 are relied upon for gas tight sealing. Air is the working gas intended for use in this particular engine-heat pump.

It is only when the device is used as an engine that hot gases are flowed over the exterior surfaces of the horizontal cylinders in the cluster in FIG. 1.

A piston rod 50 is fastened at one end 51 to the piston cluster 35 and another end 52 is fastened to a crosshead 53 which is slidable in a guide cylinder 54. Guide cylinder 54 has a flange 55 at one end which interfaces with a flange 56 on adapter 49 and the two flanges are held together by a plurality of machine screws such as the one marked 57. The opposite end of guide cylinder 54 has a flange 58 which is secured to the crankshaft housing 59 by machine screws such as the one marked 60. There is a crankshaft 65 in housing 59. The bearings for supporting the crankshaft for rotation are not shown but will be understood to be present by anyone who is familiar with engines. The crankshaft has two radially extending lobes 66 and 67 which are axially displaced from each other. There are crank pins 68 and 69 extending from the lobes. The crank pins are separated by 90 rotational degrees. A connecting rod 70 containing a bushing 71 is coupled to crank pin 69 and secured thereto by means of a split clamp 72 and some studs on which there are nuts such as the one marked 73. The other end of the connecting rod is joined to a pin 74 extending from crosshead 53. It will be evident that as the crank pin 69 orbits about the center of crankshaft 65 the crosshead 53 will reciprocate from its leftmost position as viewed in FIG. 1 to its rightmost position wherein the ends of the pistons, such as the end marked 36 in FIG. 1, nearly make contact with the header plate 28 of the cylinder cluster. By connecting the piston cluster 35 to the crank pin 69 through the agency of crosshead 53, all lateral force on the pistons is prohibited regardless of the angle which the connecting rod 70 makes with the axis of the crosshead and rod 50 which connects it to the piston cluster. This arrangement keeps friction between the pistons and cylinders in the cluster minimized because there are no components of force acting radially outwardly of the pistons towards the cylinder walls.

The cold side cluster 11 is constructed similarly to the hot side which has just been discussed so the structural details need not be repeated. It is sufficient to realize that the cold side cluster preferably has the same number of cylinders and pistons as are used on the hot side and that there are spaces between the cylinders to allow air or cooling water to flow through for the purpose of absorbing heat which is rejected by the cold cylinder assembly 11 when the machine is operating in the engine mode. A jacket for conducting a heat absorbing fluid such as air or water is symbolized by the phantom lines marked 75. For convenience, the entire cylinder cluster on the cold side is designated generally by the reference numeral 76 and the piston cluster is designated generally by the reference numeral 77. As in the hot side, the pistons are driven by way of a rod 78 attached to a crosshead 79 and to a piston header 80. The connecting rod 81 connects the crank pin 68 on the crankshaft to pin 82 on the crosshead 79 for reciprocating the pistons 77. The hot side and cold side pistons are spaced apart through an angle of 45°. Thus, although the connecting rods 70 and 81 are separated by 90° on the crankshaft with clockwise rotation as indicated by the arrow marked 83, the hot side pistons lead the cold side pistons by a rotational angle of 45°.

As is conventional in engines or heat pumps based on the Stirling cycle, the cylinders on the hot side and the cold side are connected for transferring gas back and forth by means of a heat regenerator, generally designated by the numeral 84, and comprised in this example of spherical chambers 85 and 86 connected together by a conduit 87 and communicating with the cylinders through connecting nipples 88 and 89. As is well known, the regenerator 84 contains a material such as metallic hair or screen which absorb heat from the hot gases passed from the hot side cylinders to the cold side and which readily returns that heat to the working gas when it is compressed on the cold side and returned to the hot side.

As indicated earlier, one of the new features of the Stirling cycle-heat pump disclosed herein resides in dividing what would normally be a single piston and cooperating cylinder into a cluster of smaller diameter cylinders containing smaller individual pistons driven by a single crank. A most important concomitant of this feature is that spaces are allowed between the parallel arranged cylinders so that the hot gases of combustion needed for the hot side of the engine can flow through the spaces and encounter a substantially larger area on the outside of the cylinders for transferring heat to the working gas inside of the cylinders. Forming the conventional piston and cylinder into a plurality of cylinders and pistons on the cold side also transfers heat out of the working gas more effectively by reason of the cooling air or water applied to the exteriors of the individual cylinders in the cluster having spaces between them for the cooling air and water to flow.

Another feature of the invention previously briefly alluded to is having the hot side cylinders disposed in a horizontal plane. This makes it much easier to flow hot combustion gases around and between the cylinders in the cluster by natural convection rather than requiring some means for forcing the hot gases toward the hot side cylinders. Although these features will be appreciated and understood by what has been discussed thus far, a brief review of a sequence of operations composing one cycle of the engine in reference to the diagrams represented by parts 4A–4I in FIG. 4.

Attention is invited to part 4A of FIG. 4 where the reference numerals applied to the components of the apparatus are the same as the numerals used in connection with describing the actual structure of the engine as depicted in FIGS. 1–3. Thus, the hot side of the engine is identified by the numeral 10. A single cylinder is shown but it will be understood that the cylinder and the piston therein simulate a cluster according to the invention as in the actual device shown in FIGS. 1–3.

Assume that the Stirling cycle device is to operate in the engine mode. In 4A the cold side piston and cylinder cluster is designated generally by the numeral 11 and the hot side cluster by the numeral 10. For economy and simplicity the working gas used in the system is assumed to be air although it could be hydrogen and helium. The piston-cylinder clusters 10 and 11 are separated by an angle of 45°. Connecting rod 70 connects the crank pin 69 to the hot side piston and connecting rod 81 connects the crank pin 68 to the cold side piston-cylinder cluster. The crank is rotating as viewed in 4A–4I and it is assumed that the engine has been started and is functioning in its normal way. In 4A, every 45° of the crank rotation is indicated by a light reference line. In 4A, the cold side 11 piston is presently moving toward the closed end of the cylinder and is compressing the working gas. It is near the end of its compressive stroke. As is typical of Stirling engines the ideal situation is to compress the working gas isothermally so heat must be transferred out of the cold side 11 cylinder during compression. The pressure within cold side cylinder 11 also exists within the conduit and regenerator which are connected between the cold side 11 and hot side 10 cylinder clusters The crank pin 69 driving the hot side 10 piston is at its top dead center angle and the hot side 10 piston is at the end of its stroke at the moment in 4A. Burner 33 is developing hot gases of combustion which are being flowed over all of the cylinders in the cluster of hot side 10.

In 4B, crank pin 68 which drives the cold side 11 piston is at top dead center and compression of the working gas in the cold side cylinder is at maximum. At this moment, the cold side piston cluster is beginning to retract and pressurized working gas is starting to transfer to the hot side 10 cylinder cluster.

In 4C, it is evident that the hot side piston is moving by a substantial amount in what constitutes a power stroke. The working gas in the hot side cluster of cylinders is concurrently absorbing heat from the hot combustion gases evolving from burner 33 so energy is being added to the working gas. The ideal angular relationships of the hot and cold side pistons at this time would bring about exothermal expansion of the working gas in the hot side 10 cluster of cylinders.

In 4D the crank pins 68 and 69 have each rotated 45° beyond their 4C angular positions and the hot side 10 piston is nearing the end of its power stroke.

In 4E, the hot side 10 piston is at bottom dead center or the end of its power stroke and the cold side piston is still retracting.

In 4F, the cold side 11 piston is at bottom dead center and the crank is turned relative to its 4E position by an angle which has started the hot side piston cluster moving towards the closed ends of the cylinder cluster. This is the start or zero point of compression in the cold side cylinder cluster.

In 4F, the cold side 11 piston cluster is retracted by the maximum amount which corresponds to the volume in the cylinders of the clusters being maximized at this time. In 4F, crank pin 69 has already rotated 45° beyond its 4E position and it is starting to drive the hot side 10 piston cluster towards the closed ends of the cylinders such that the hot working gas which expanded to provide a power stroke is now being forced back into the cold side 11 cluster of cylinders. During this time, the heat absorbing material in the regenerator 84 removes heat from the hot working gas so the material becomes very hot.

In 4G, the process of the hot side 10 piston cluster forcing the hot gas into the cold side 11 cylinder cluster continues Because the hot side 10 piston always leads the cold side 11 piston by 45°, the working gas in 4G is emptying from the hot side cylinder while the cold side piston is not too far along in the compression stroke so the hot side piston can operate against a lower pressure than would be the case if the two piston clusters were in phase.

In 4H, the hot side 10 piston cluster is approaching dead center while the cold side piston cluster is moving in a direction to continue increasing the pressure of the working gas. This process continues until the crank pins 68 and 69 attain the positions which they are in 4I. In 4I, compression in the cold side 11 cylinder cluster is maximized and one operating cycle of the engine has ended in the condition in which it began in 4A. During the next cycle, when the compressed gas is being transferred from the cold side 11 cylinder cluster to the hot side 10 cylinder cluster the working gas will absorb or acquire heat from the regenerator 84 to add to the heat which is transferred to the working gas in the hot side cylinder cluster by heat from burner 33.

When it is desired to use the device as a heat pump for heating a building, for example, a crankshaft is driven rotationally by an electric motor, not shown. Burner 33, of course, is not used. If it is desired to heat a building or a room therein, the piston and cylinder cluster 11 can be considered the hot side. The hot side would be arranged in the room isolated from the cold side. In a practical case, a stream of air would be directed over the hot side 11 of the heat generated by compressing the gas in the hot side cylinders could be transferred to water in a jacket, not shown, which maintains the cylinders in water and provides for the water in the jacket being circulated by a pump, not shown, to radiators in a room which is to be heated. The other piston and cylinder cluster 10 can be considered cold side and would be placed in a duct which would provide for passing ambient air from outside of the building over the hot side 10. Thus, in part 4A of FIG. 4 the working gas is being compressed at the moment in cylinder 10 which causes the gas to get hotter. This heat can be transferred to the air in the room which is to be heated by circulating air or water over the cylinders 11. 4B represents the end of the compression cycle. The cold side 10 piston is retracting and the gas which has been forced from the hot side piston 11 into the cold side cylinder 10 is expanding. When the hot gas from cylinder 11 flowed through the regenerator 84 on its way to cold side cylinder 10, heat is absorbed in the regenerator. Of course, some of the heat developed in the hot side cylinder has already been given up to the room.

The cold side 10 piston continues to retract through 4D and reaches its maximum retraction in 4E where the gas in the cold side cylinder has expanded as much as possible During this expansion, the working gas in the cylinder has continuously absorbed heat from the ambient air fed in from the outside of the building. In 4G, the cold side 10 piston has been forcing the working gas into the hot side 11 cylinder. As the gas flowed from the cold side 10 to the hot side 11 the gas absorbed heat from the regenerator.

In 4H, most of the working gas is inside of hot side cylinder 11 and is being compressed so that heat which is incidental to compress the gas and heat which has been recovered from regenerator 84 is again transferred to whatever medium surrounds the hot side cylinders and which is radiated into the room. In 4I, the pistons are restored to where they were in 4A at the start of a compression phase and the cycle just described is repeated. Thus, the device serves to absorb thermal energy at a low level from air outside of the building and the device converts mechanical energy into heat energy which is retained in the working gas and is transferred to the cooler room air from the surfaces of the cluster of cylinders in the hot side of the heat pump when it is used in the heating mode as just described It will be evident to those skilled in the art without further discussion that the device, performing in accordance with the Stirling cycle can also be used to cool a space such as a room or rooms in a building by locating the side 11 cylinder and piston cluster in a stream of air from outside of the building so that the working gas, when under compression, can give up heat to the outside air. Then, of course, the other side 10 cylinder and piston cluster would be located in the room which is to be cooled by having a stream of room air or water flow over the side 10 cylinder cluster for absorbing heat from the air in the room.

It will be understood, of course, that in a practical application of the new cluster piston and cylinder utilizing engine-heat pump that the known practice of having heat exchangers installed between the side 11 cylinder clusters and the regenerator 84 and between the regenerator and the side 10 cylinder cluster will be followed as in conventional Stirling engines or heat pumps in which the single pistons are not subdivided to form a cluster for being interconnected by a crankshaft or other mechanism in accordance with the invention.

I claim:

1. An external combustion machine comprising:

a first cluster of cylinders, each having a hollow interior for accommodating a working gas, said cylinders being arranged in parallelism and spaced apart to provide passageways for a fluid heat transfer medium to contact the exterior surfaces of the cylinders, first header means containing a passageway to which corresponding ends of said cylinders are coupled for communicating said cylinders with each other, a piston in each cylinder in the first cluster and connecting means for connecting all of said pistons together for being reciprocated together in said cylinders, a second cluster of cylinders, each having a hollow interior for accommodating said working gas, said cylinders in the second cluster being arranged in parallelism and spaced apart to provide passageways for a fluid heat transfer medium to contact the exterior surfaces of spaced cylinders, a piston in each cylinder in the second cluster and connecting means connecting said pistons together for being reciprocated together in said cylinders, second header means containing a passageway to which corresponding ends of said cylinders in the second cluster are coupled for communicating said cylinders with each other, mechanical means for coupling said connecting means of the first and second clusters of pistons together in a manner which provides for one cluster of pistons to lead the other when reciprocating in said cylinders, and conduit means interconnecting said passageways in the headers to provide for transferring said working gas back and forth between said first and second clusters of cylinders during a machine operating cycle.

2. The Stirling cycle machine according to claim 1 wherein said mechanical means comprises a crankshaft having a rotational axis and crank pin means having parallel axes displaced radially outwardly of said rotational axis and separated by a predetermined angle of rotation, members coupling one of said crank pin means to said connecting means of said pistons in the first cluster of cylinders and members coupling the other of said crank pins to said connecting means of said pistons in the second cluster of cylinders.

3. The machine according to claim 2 wherein there are a plurality of first cylinder clusters with pistons in the cylinders coupled to said crankshaft for being reciprocated together and a plurality of second cylinder clusters with pistons in the cylinders coupled to said crankshaft for being reciprocated together.

4. The machine according to any one of claims 1 or 2 wherein the cylinders in said first cluster are arranged horizontally and the cylinders in the second cluster are arranged at an angle relative to said first cluster.

5. The machine according to claim 4 wherein said angle is 45 degrees.

6. The machine according to claim 4 including a fuel burner for producing said heat transfer medium in the form of hot gases of combustion confined to flow over and between said horizontally arranged cylinders at the end portions of said cylinders which are coupled to said header means for operating said machine in an engine mode.

7. The machine according to claim 1 including a regenerator in said conduit means.

8. The machine according to claim 4 including means for directing said fluid heat transfer means over the exterior surfaces of the cylinders in one of said clusters and said medium is one selected from the group consisting of water and air.

* * * * *